US007481145B1

(12) United States Patent
Turner, Jr.

(10) Patent No.: US 7,481,145 B1
(45) Date of Patent: Jan. 27, 2009

(54) CRUISE MUNITIONS DETONATOR PROJECTILE

(76) Inventor: Louis Turner, Jr., 701 S. Wells St., Unit #1005, Chicago, IL (US) 60607

( * ) Notice: Subject to any disclaimer, the term of this patent is extended or adjusted under 35 U.S.C. 154(b) by 274 days.

(21) Appl. No.: 11/401,762

(22) Filed: Apr. 11, 2006

(51) Int. Cl.
*F42C 17/00* (2006.01)

(52) U.S. Cl. ..... 89/6.5; 102/464; 102/473

(58) Field of Classification Search ..... 102/464, 102/473; 89/6.5; D22/116
See application file for complete search history.

(56) References Cited

U.S. PATENT DOCUMENTS 3,777,665 A * 12/1973 Ziemba ..... 102/215
4,237,789 A * 12/1980 Stauers et al. ..... 102/270
4,309,946 A * 1/1982 Block ..... 102/213
4,711,152 A * 12/1987 Fortunko ..... 89/6.5
5,936,188 A * 8/1999 Atkinson ..... 102/380
7,021,187 B1 * 4/2006 Grassi ..... 89/6.5
2004/0237825 A1 * 12/2004 Ronn et al. ..... 102/211

* cited by examiner

*Primary Examiner*—Michael Carone
*Assistant Examiner*—Samir Abdosh

(57) ABSTRACT

A projectile, (Cruise Munition Detonator Projectile or CMDP), can be fired from a tank, modified grenade launcher or gun using a laser range finder, radar or manual input (dialer or keypad) range selector. The CMDP will prevent, neutralize and eliminate enemy close infighting. The CMDP can defend aircraft against SAM, shoulder launched missiles, and air-to-air missiles. The CMDP will travel a predetermined programmed distance and detonate in front of or behind, over or beside, or in the mist of a target. The CMDP allows small forces to strategically neutralize larger forces with devastating effect. The CMDP is a force multiplier and an anti-personnel weapon.

8 Claims, 17 Drawing Sheets

Cruise Munitions Detonator Projectile

Cruise Munitions Detonator Projectile

BASE PLATE (side view) data wire feeding into and through the seal

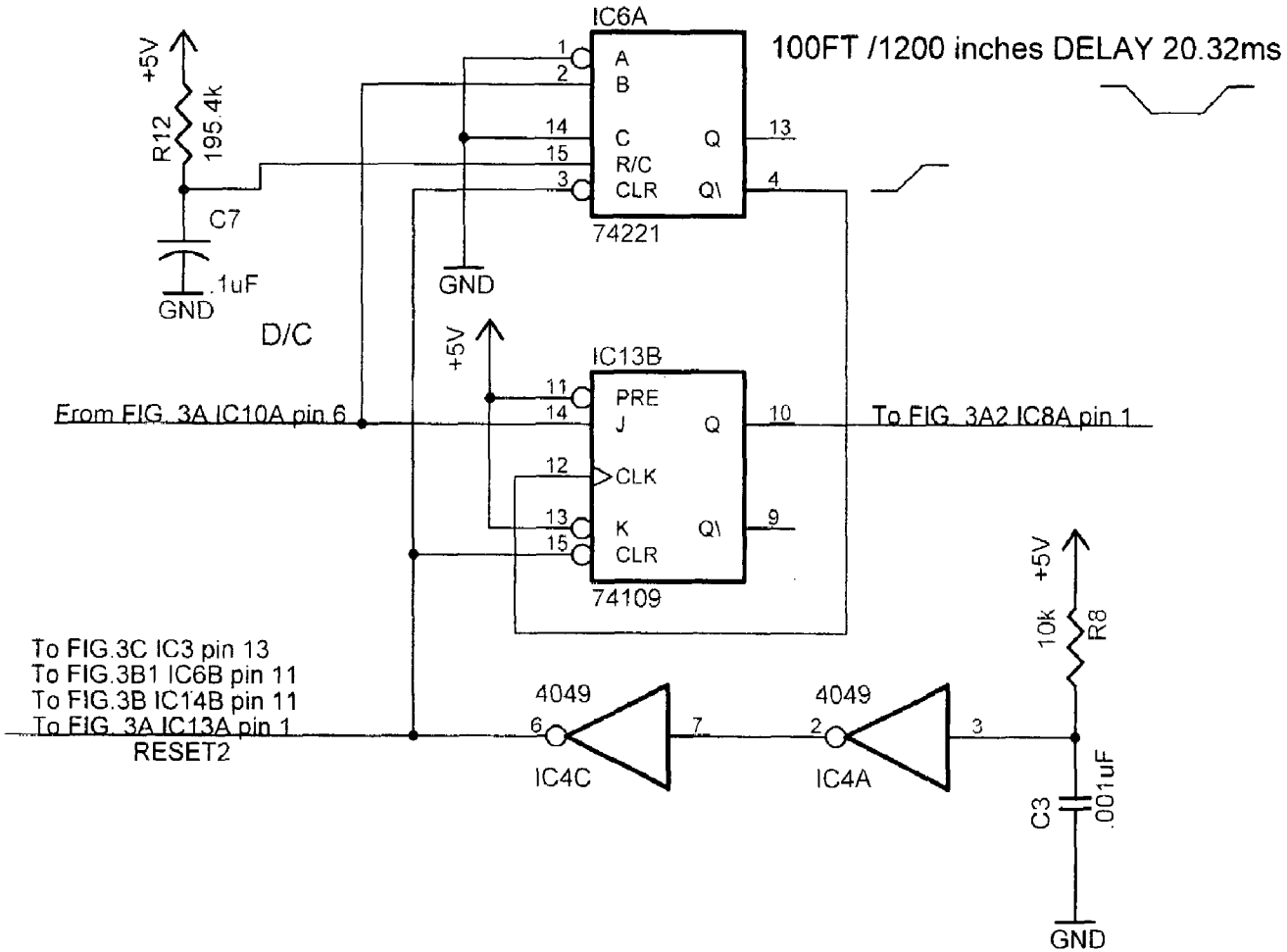
FIG. 3A1

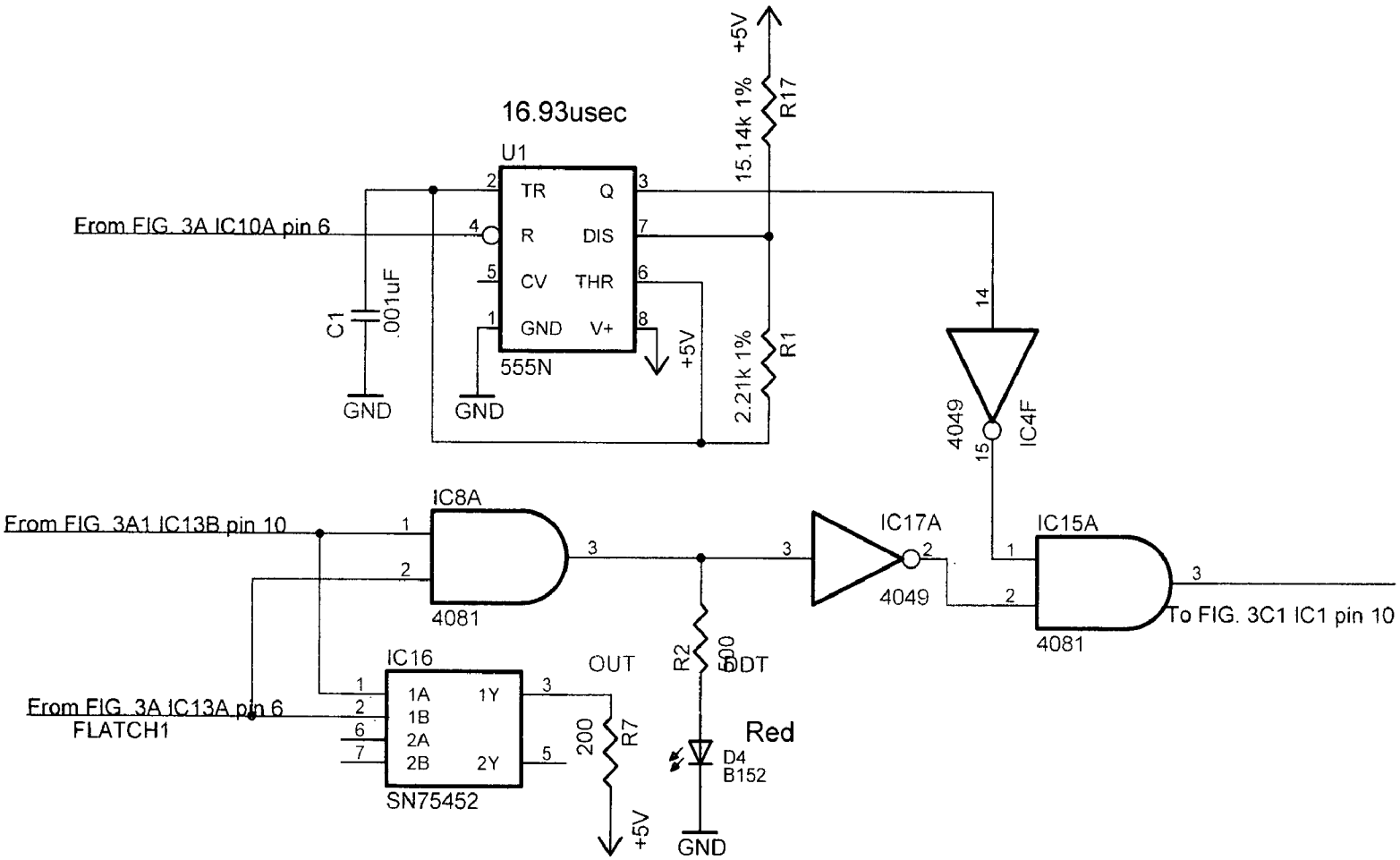
FIG. 3A2

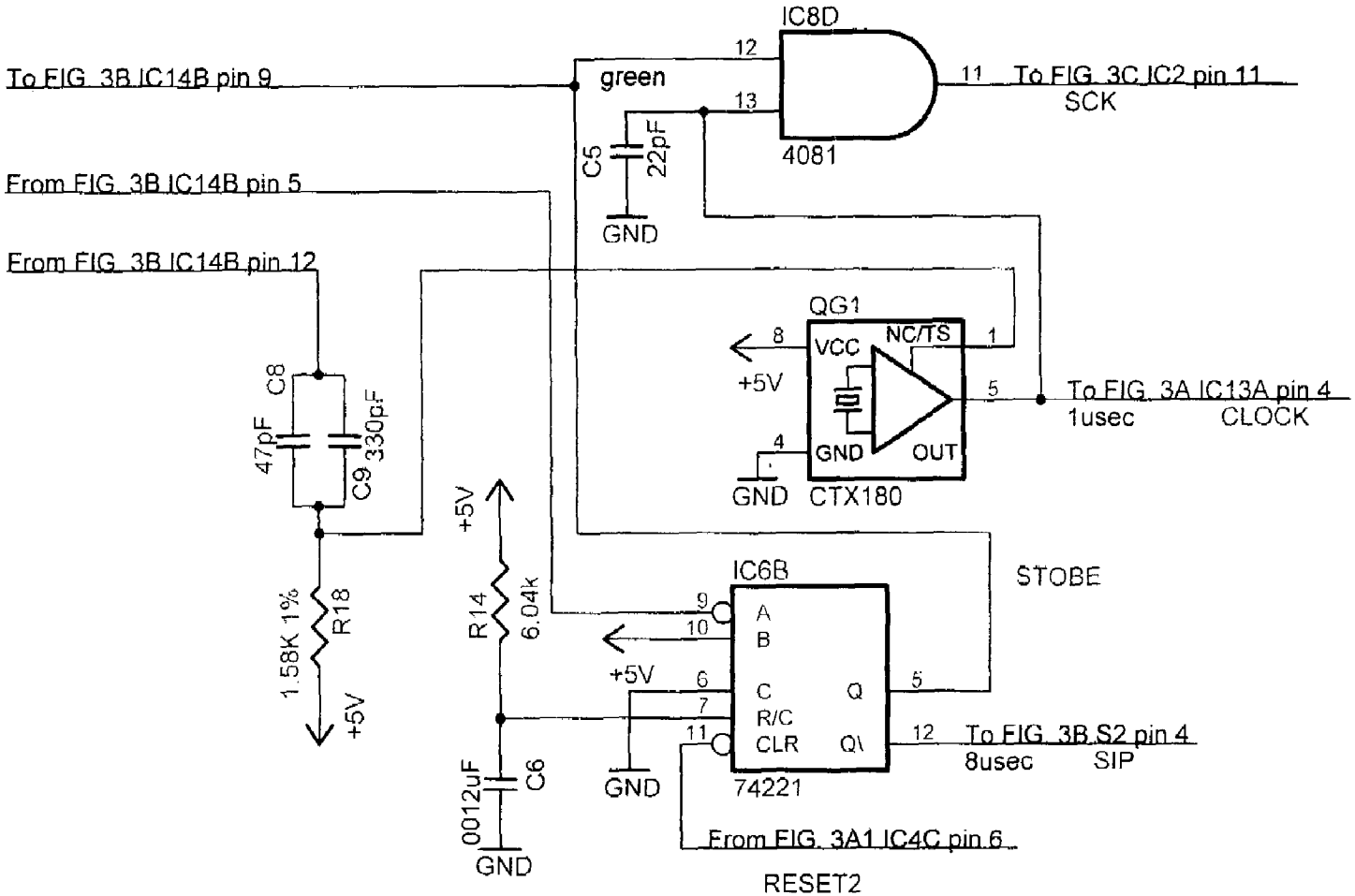
FIG. 3B1

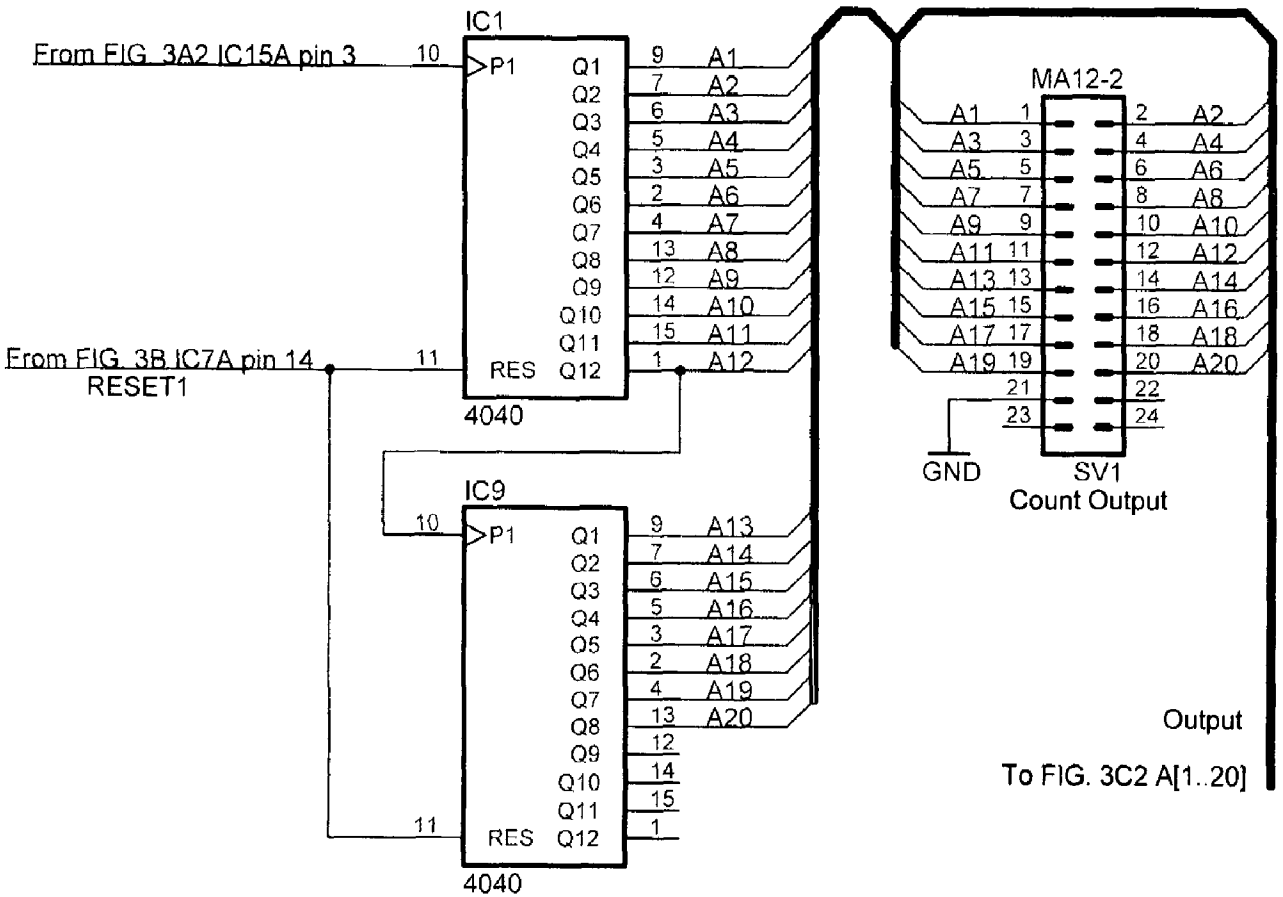
FIG. 3C1

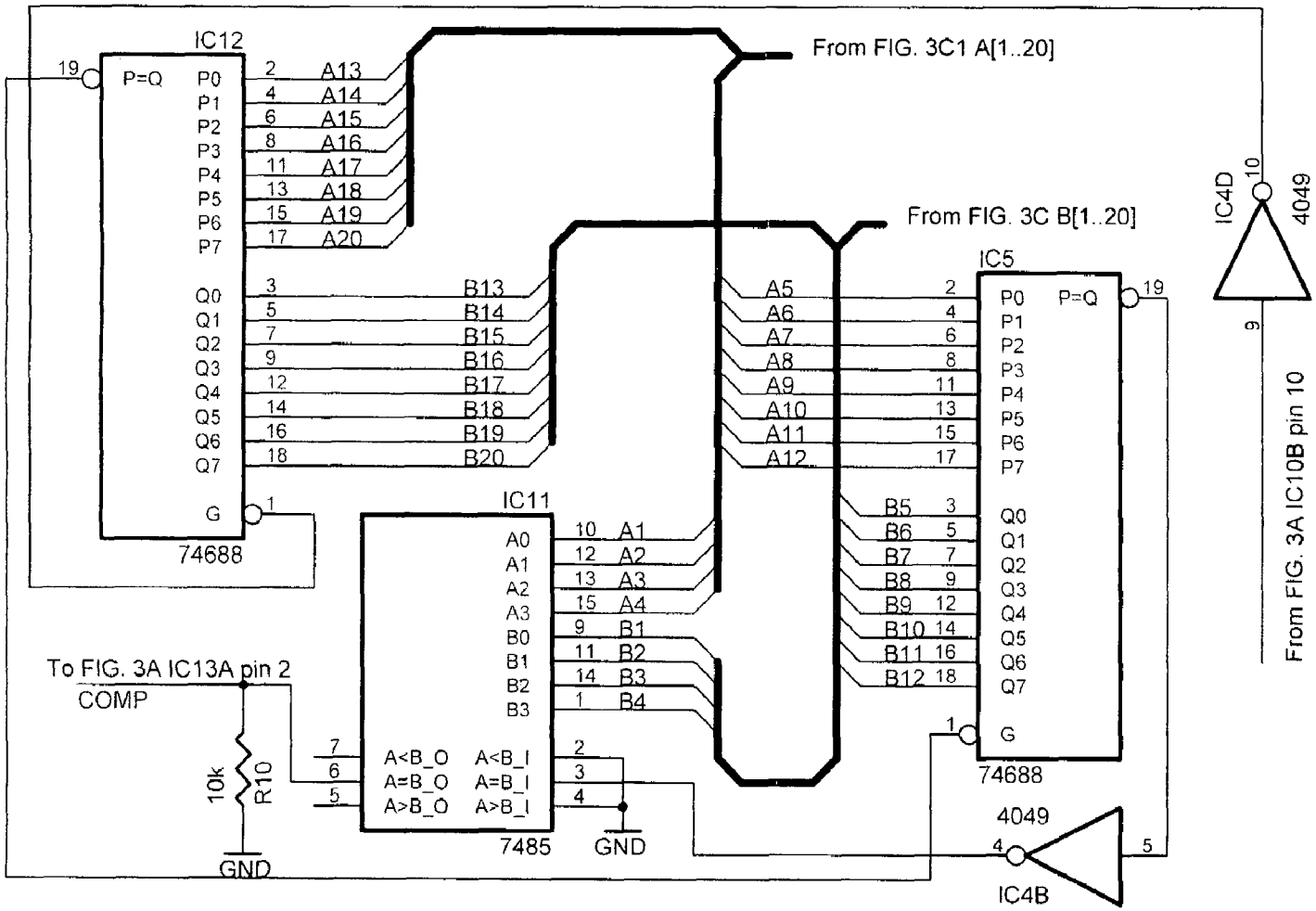
FIG. 3C2

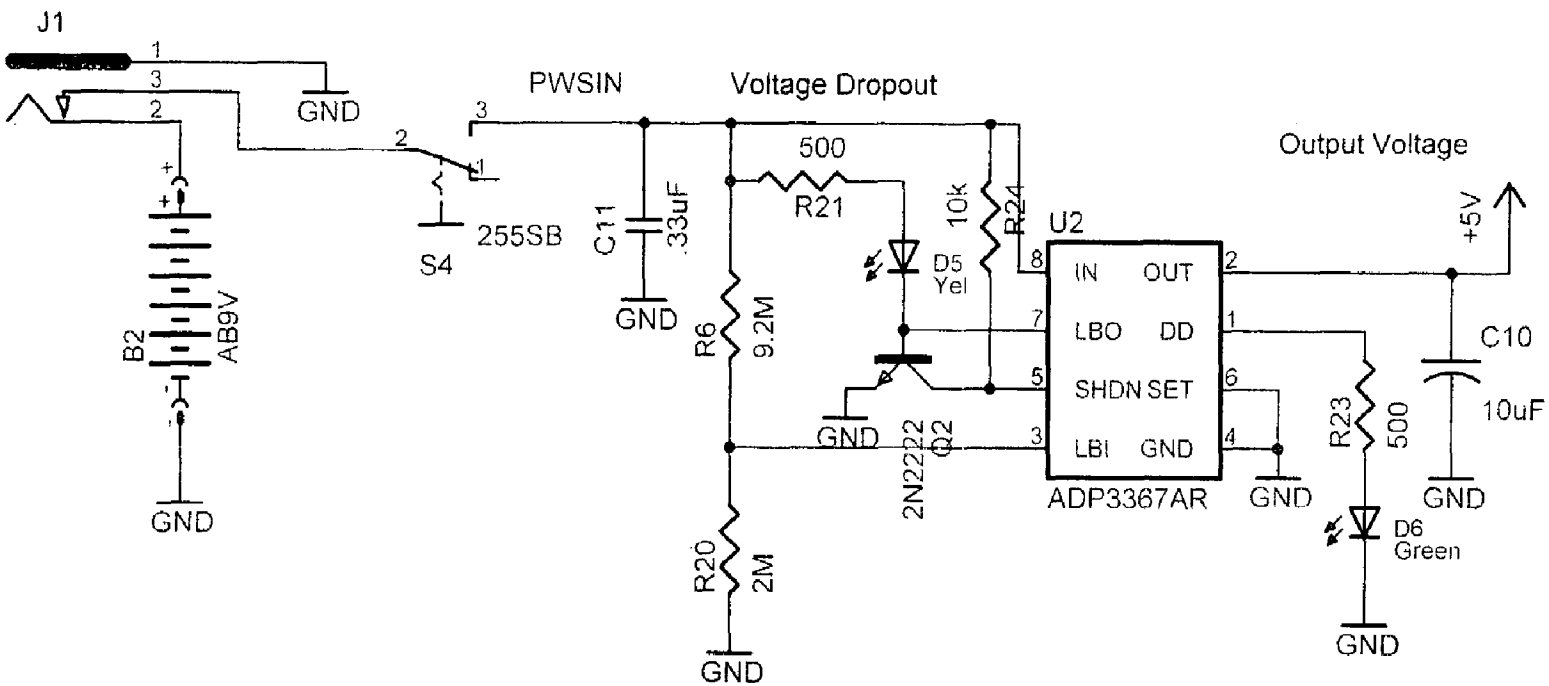
FIG. 3C3

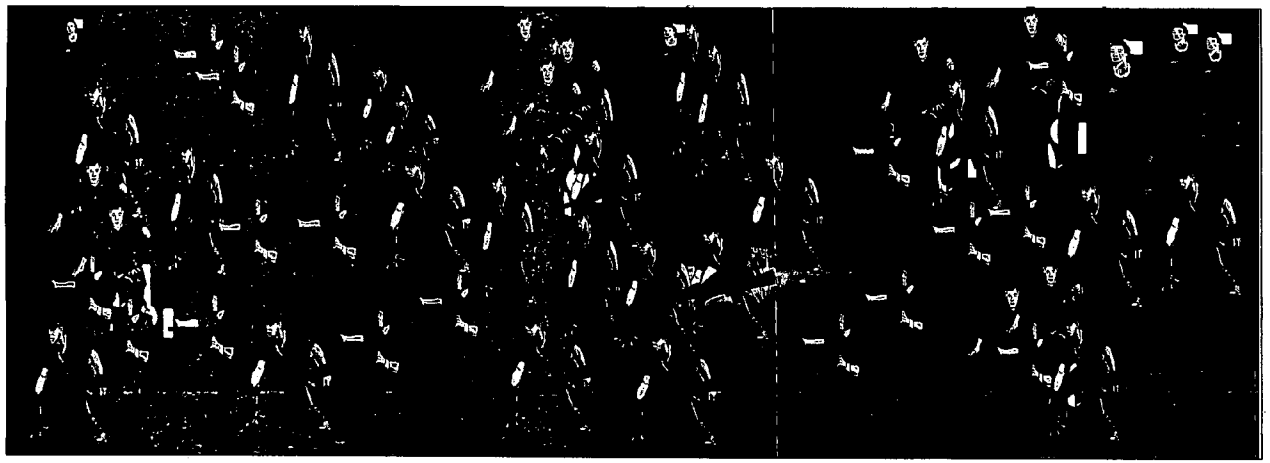
Illustrates: An enemy force attacking friendly forces before being destroyed by the tank below.
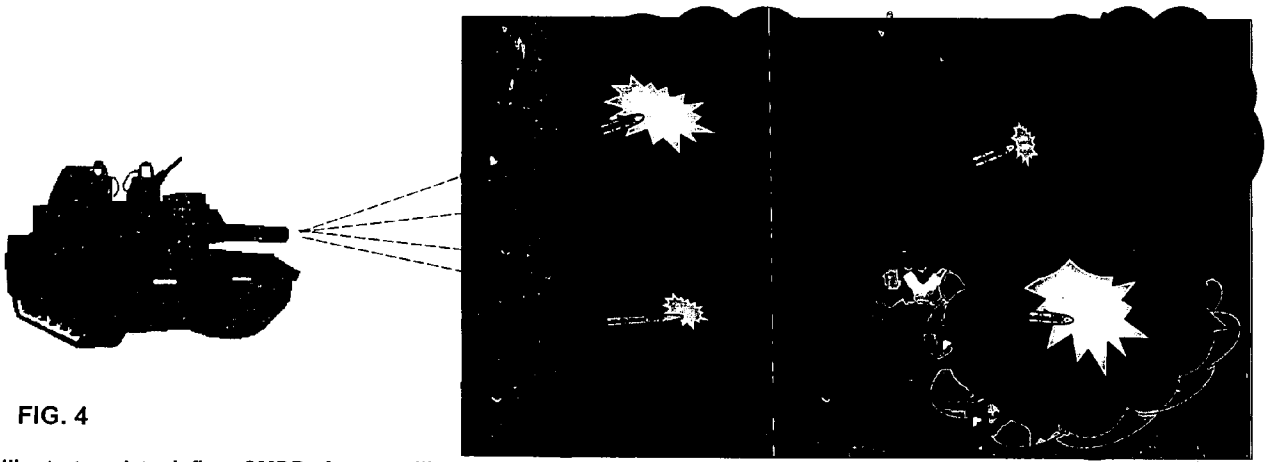
FIG. 4
Illustrates: A tank fires CMDPs from a mille away into the mists of the (above) advancing enemy force. CMDP detonations destorys the unit.

Illustrates: CMDPs fired from a helicopter destroying shoulder launched missiles.

Illustrates: CMDP detonating above enemy soldiers hiding in a crater.

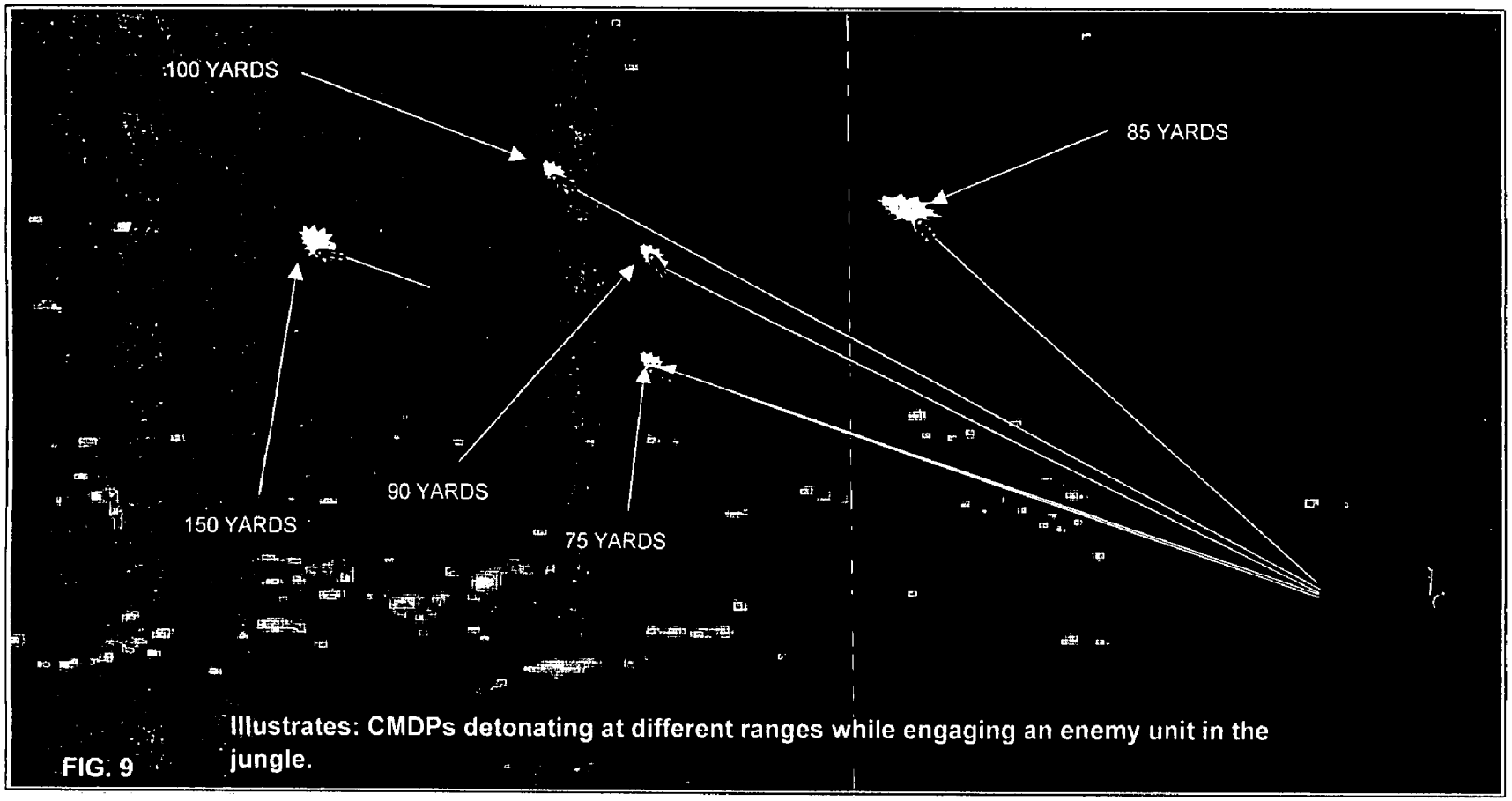
FIG. 9 Illustrates: CMDPs detonating at different ranges while engaging an enemy unit in the jungle.

MUNITIONS TIMER INPUT & OUTPUT TIMMING CHART

CRUISE MUNITIONS DETONATOR PROJECTILE

FIELD AND BACKGROUND OF THE INVENTION

The present invention is a standoff force multiplier weapon, distance controlled device, enemy neutralization, and casualty reduction.

When the U.S. military goes to war, it relies on sophisticated and efficient weaponry to defeat the enemy. Yet, no matter how sophisticated the weapons, an all-volunteer military cannot absorb large numbers of causalities. In an effort to reduce the number of causalities suffered by our troops, modern weapons are designed to deliver payloads from great distances with uncanny accuracy. Although these standoff weapon systems are intended to eliminate close infighting; pitch battles and firefights remain an integral part of military planning and tactics.

Close infighting causes causalities because the ideal weapon balance has not been introduced into battle with the intention of neutralizing the enemy; rendering hiding useless; and eliminating counter fire. Many casualties occur when the enemy takes cover and returns fire. In fact, the best way to stop enemy forces is to prevent them from ever using their weapons. If the enemy is deprived of the ability to return fire, the probability for causalities becomes near zero. The solution is to overwhelm the enemy with a firewall of pinpoint airburst detonations at the onset of battle and continue until the enemy is destroyed. The radius of the airburst detonations will devastate both the exposed and concealed; only if the firepower is instantaneous, overwhelming and totally destructive. Fortunately, a new innovative weapon called the CMDP can accomplish both tasks simultaneously. The CMDP or Cruise Munitions Detonator Projectile is a weapon created to travel a predetermined distance to the enemy and detonate with pinpoint accuracy anywhere in the enemy's range or vicinity. The detonation of a single shell will suppress enemy fire and neutralized them at the same time.

What makes the CMDP so deadly is: a) the distance to the target is determined by a range dial selector, laser range finder or radar, b) firing the gun and downloading range data into the CMDP's memory is done simultaneously, and c) the CMDP travels the distance to the target along a straight path and detonates. It can also be modified to detonate on impact.

The CMDP application is not just limited to ground forces, it can also be used on aircraft; tanks; in military camps; and aboard ships. CMDPs can be used with a modified grenade launcher to substitute for Claymore mines if motion detector sensors (systems) are positioned around the perimeter of a field camp. Aircraft, such as jets or helicopters equipped with the CMDP (along with an automatic tracking and aiming system) could defend themselves against enemy aircraft: SAMS, shoulder launched missiles and air-to-air missiles. By firing and detonating a CMDP or (CMDPs) at intersecting points along the object's fight path, the target will be destroyed. Current aircraft equipped with detection devices only warn of impending dangers, using flare and chaff dispensing systems to redirect threats, in order to evade them. Evading works sometimes, but the threat must be eliminated altogether to have a zero causality equation loss. AAA threats against attacking aircraft over a target area can be controlled and neutralized using the CMDP. Aircraft like the B52 bomber and A-10 Warthog could operate with impunity over targets while using the CMDP to destroy heat seeking missiles. And, if an aircraft lands in enemy territory, an undamaged CMDP/system has the potential to defend the aircraft and those on board.

Unlike defense systems aboard ships where bullets must hit targets, the CMDP simply detonates in the path of the target. As described, the CMDP can be used as a defensive or offensive weapon. A Tank's main gun is another weapon platform that is known for its destructive power, but it too, has weaknesses against air-to-surface and shoulder launched missiles, which cause great causalities. Faced with immeasurable odds, multiple CMDPs fired from tanks can destroy hundreds, even thousands of enemy troops. And, when equipped with an automatic tracking and aiming system, a tank can defend itself against shoulder launched missiles and air-to-surface missiles by firing and detonating a CMDP or CMDPs at intersecting points along the object's fight path.

Mortar attacks make military camps unsafe, resulting in loss of life and property. Lives can be saved with near zero percent causality if software controlled tracking systems equipped with CMDPs are used to defend against incoming mortar. Gun systems can be daisy-chained to secure the entire camp.

When Special Ops, patrol or recon units are in a jam and pinned down, they call in fire support to neutralize the enemy. If the action is too close; firing on the target is not an option. Without accurate firepower there will be no escape, resulting in inevitable causalities. These situations can be avoided if the units are armed with CMDPs, fitted with a modified grenade launcher equipped with a range dialer, laser range finder and thermo heat sensor. US forces should be confident that they have instantaneous and overwhelming firepower with them when fighting their way into and out of situations. The CMDP allows smaller forces to strategically neutralize larger forces with devastating effect.

The CMDP is the optimum weapon for ground troops to engage snipers hiding on mountain ridges, in trees, rooftops, or building openings used as cover. It can also neutralize reinforced bunkers or weapons platforms. As previously stated, the CMDP is launched from a gun using a combination of a range selector; laser range finder, thermo sensor and radar to determine the distance to a target and to download the data into it. Adding or subtracting a quantity to or from the input data will achieve a desired distance. Aiming at a target is accomplished with a stand-alone gun or software controlled tracking system. The CMDP distance to the target is very accurate and is limited only by its range.

SUMMARY OF THE INVENTION

According to the present invention there is provided a CMDP for neutralizing large enemy ground forces and missiles while defending against enemy moving objects. The CMDP includes a data link and memory for downloading distance target information; a safe distance arming circuit; a pressure switch for initializing digital counting; and a comparator circuitry that determines the detonation time.

According to one embodiment of the present invention, the CMDP is a shell requiring data input.

According to another embodiment of the present invention, the CMDP is a shell. Preferably the shell is launched from a gun type system, tank or modified grenade launcher gun.

According to a preferred embodiment of the present invention, the CMDP is a projectile. Preferably the projectile is launched to predetermined distances and then detonates.

According to still further features in the described preferred embodiment, the projectile is a munitions.

According to another feature in the described preferred embodiment, the projectile includes electronic circuitry for launch detection.

According to still further features in the described preferred embodiment, the projectile includes an electronic safety circuit to arm the CMDP for detonation after clearing a safety zone.

According to the described preferred embodiment, the projectile includes electronic circuitry for downloading range data into memory for targeting range.

According to the described preferred embodiment, the projectile includes electronic circuitry for counter comparison detection to accurately determine when to detonate the munitions.

According to a preferred embodiment of the present invention, the CMDP further includes electronic circuitry to detonate the projectile.

According to a preferred embodiment of the present invention, the CMDP can be used to defend aircraft, warships and military camps against incoming missiles, mortars and enemy aircraft.

According to a preferred embodiment of the present invention, the CMDP can be used to defend aircraft and passengers against enemy forces after forced landings.

According to a preferred embodiment of the present invention, the CMDP can be used to neutralize distant targets.

According to a preferred embodiment of the present invention, the CMDP can be used to reduce and eliminate casualties.

According to a preferred embodiment of the present invention, the CMDP can be used to neutralize large enemy forces.

BRIEF DESCRIPTION OF THE DRAWINGS

The invention is herein described by way of: an illustrated modified shell shown in FIG. 1 and the tested CMD schematic circuit shown in FIG. 3A, FIG. 3A1, FIG. 3A2, FIG. 3B, FIG. 3B1, FIG. 3C, FIG. 3C1, FIG. 3C2 & FIG. 3C3. The notation FIG. 3Xn will refer to all of the above figures:

FIG. 1*e*, is a cross-section diagram showing the pressure switch in said projectile according to one embodiment of the preferred invention;

FIG. 1*j*, is a diagrammatic cross-section showing the Cruise Munitions Detonator (CMD) location in the projectile according to one embodiment of the preferred invention;

FIG. 4, is a diagram of a tank according to one embodiment; firing CMDPs into the mist of a large enemy force.

FIG. 9, is a diagram of multi CMDPs according to one embodiment, defending against larger enemy formations;

DESCRIPTION OF THE PREFERRED EMBODIMENTS

The present invention pertains to a projectile that detonates in mid-air after traveling along a programmed flight path and predetermined distance. The flight path of the projectile is determined by the operator or guidance system and is maintained in flight by its initial velocity. Specifically, the present invention can be used to neutralize larger enemy forces; combatants hiding behind objects or strategically placed combatants on the battlefield. The CMDP can also be fired from any aircraft or helicopter as an anti SAMS device, anti shoulder rocket device or anti air-to-air missile device. It would work well in neutralizing incoming mortar rounds in mid-air before they ever strike the ground. It can be deployed on aircraft as an excellent anti dog fighting weapon. Operating as an anti projectile eliminator, each system will use a radar or laser tracking system, electronic distance measuring and calculating software (firmware), and an aiming device. The CMDP can be used to destroy moving or stationary targets. The CMDP allows one tank to fully engage larger size troop threats with efficient use of munitions, which means that the CMDP is a force multiplier.

Modified Shell

Figure 1:
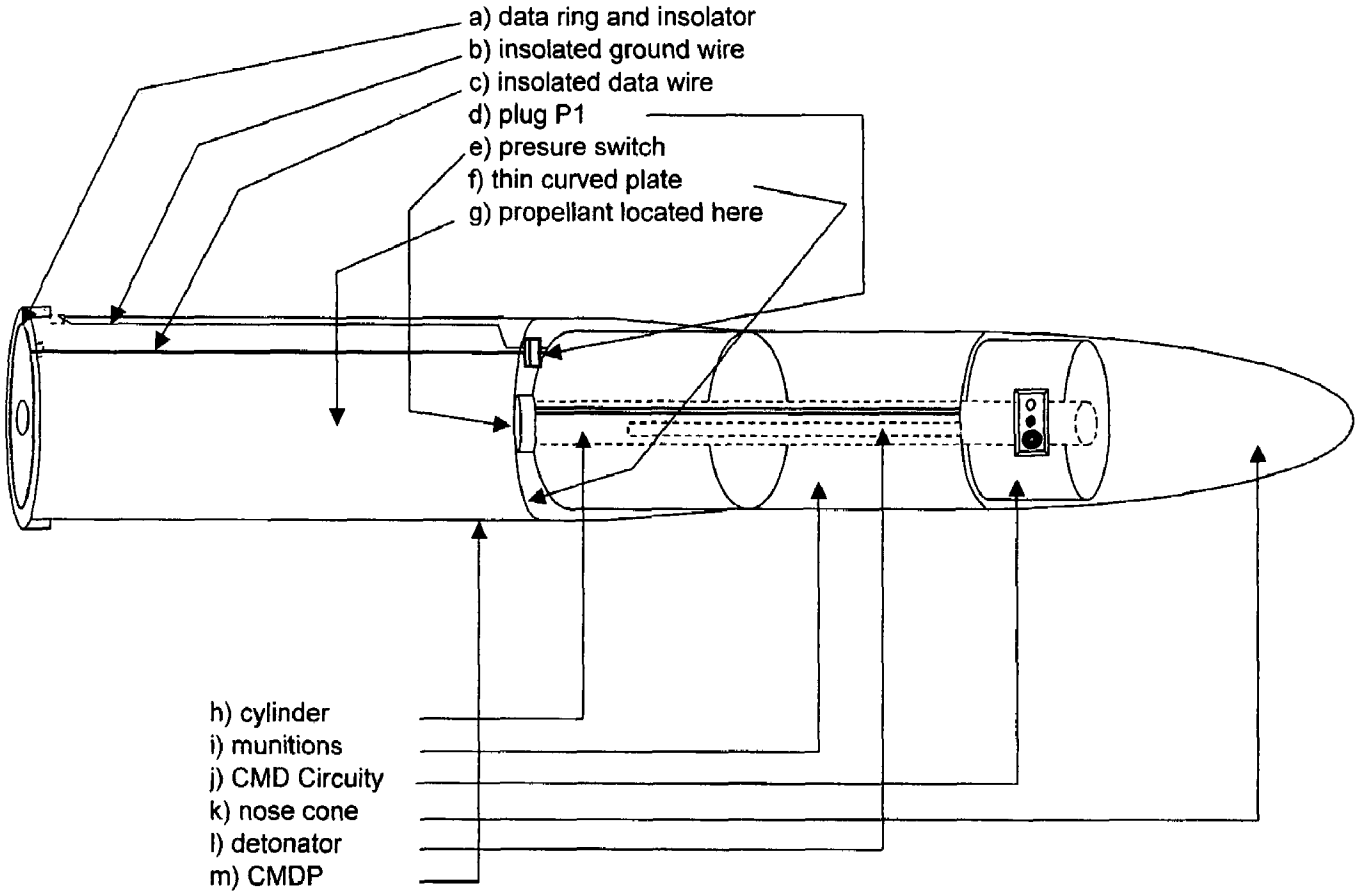
FIG. 1, is a diagrammatic cross-section of a projectile according to one embodiment of the present invention wherein the projectile is a modified shell.
Figure 2:
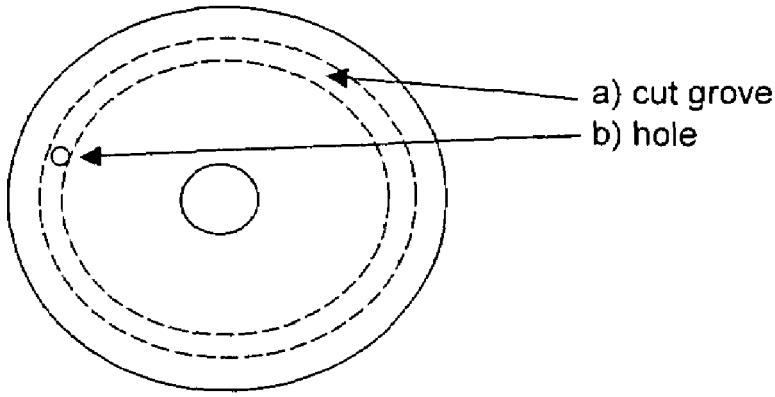
FIG. 2, is a diagram of the modified shell base plate according to an embodiment of the preferred invention.
Figure 2A:
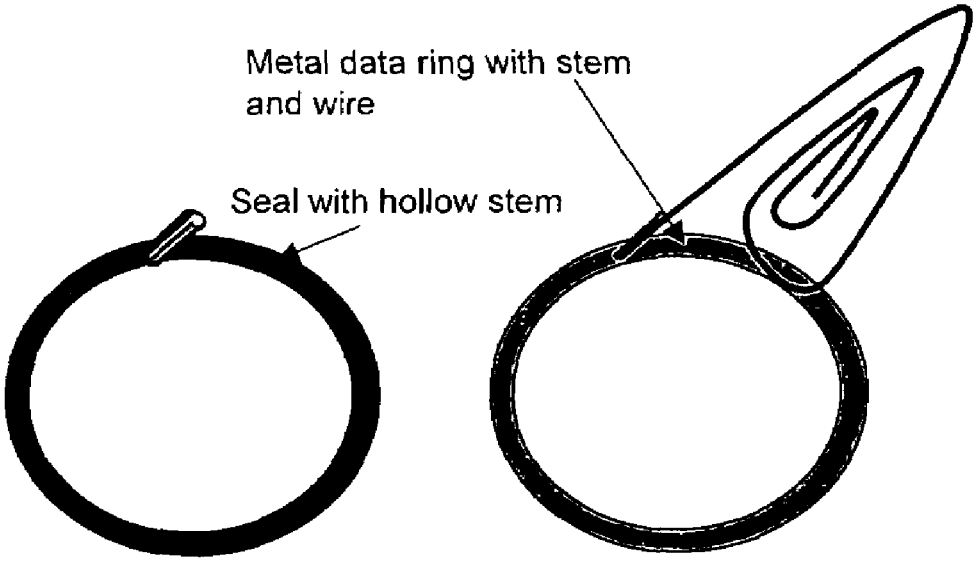
FIG. 2A, is a diagram of the seal and metal data ring according to one embodiment of the preferred invention.
Figure 2B:
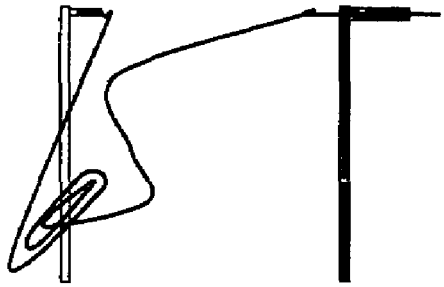
FIG. 2B, is a diagram of the data wire feeding into the seal according to one embodiment of the preferred invention.

For the purpose of the present description and appended claims, by way of modified shell design (example only):

A surface groove is symmetrically cut into and around the base plate as shown in FIG. 2, and a small hole is drilled through the base plate within the path of the groove. The groove is deep enough to overlay the seal and metal data ring and remain flush with the surface of the base plate. FIG. 2A, shows a small AWG insulated wire attached to the stem of the data ring. The wire is aligned with the seal and pushed through the opening in the seal and into the shell as shown in FIG. 2B. The seal insulates the metal data ring from the shell's metal base plate. An insulated ground wire is soldered and insulated onto the inside of the shell and terminates into an insulated plug along with the data wire inside the shell see FIG. 1*b*. The shell is then filled to a predetermined level with propellant (not shown) FIG. 1*g*. A thin curve plate in FIG. 1*f*, is placed over the propellant with the plug on top. An insulation material or foam is than used to insulate the plug from the other components (not shown). The pressure switch rests on top of a thin plate and makes contact as shown in FIG. 1*e*.

The base plate of a shell is modified (modified shell) to allow data to be transferred to the CMDP's memory. The CMDP's internal wires terminate into plug P1, as shown in FIG. 1*d*.

A cylinder is fastened to the center of the CMDP circuitry housing. The cylinder houses the pressure switch wires and data link wire. The detonator (not shown) is placed in the cylinder as shown in FIG. 1*h*. The munitions type (not shown) is placed around the cylinder and filled to a predetermined level see FIG. 1*i*. FIG. 1*j*, shows the CMDP circuitry (CMD) housing. The nose cone is secured onto the projectile see FIG. 1*k*.

CMP Circuitry Schematic (CMD)

For the purpose of the present description and appended claims, by way of schematic circuitry design (tested); the present invention describes the CMD electronic schematic and refers to components, operations and functions in FIG. 3A, FIG. 3A1, FIG. 3A2, FIG. 3B, FIG. 3B1, FIG. 3C, FIG. 3C1, FIG. 3C2 & FIG. 3C3. As stated in the "BRIEF DESCRIPTION OF THE DRAWINGS", the notation FIG. 3Xn will refer to all of the above figures. The schematic diagrams also shows an array of circuit components interfaced to create block circuit operations needed to make the CMD work. The term FIG. will refer to a sheet, and all components located on the same sheet will be describe by their components.

The operational objective is to input three 8-bit synchronized words into memory and transfer them to a 20-bit BUS B. Then activate the counter, create a detonation safe zone and a 20-bit BUS A, while continuously counting; comparing BUS A & B until they match and then activate the detonator.

Figure 3A:
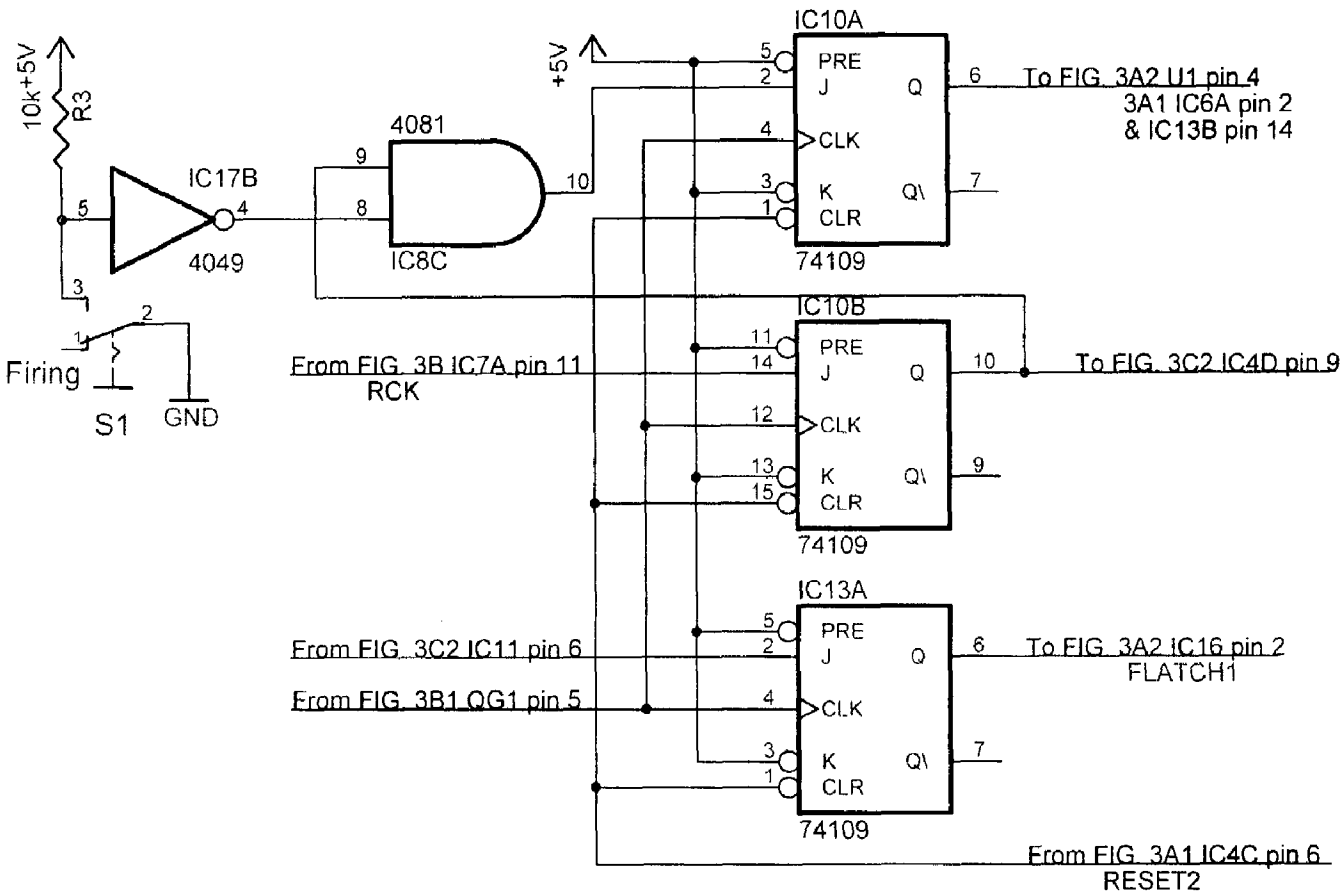
FIG. 3Xn, is the CMD circuit schematic according to one embodiment containing the pressure switch; memory data storage circuitry; counting and comparator circuitry; safe distance circuitry, detonation enabling circuitry and voltage regulator.
Figure 3B:
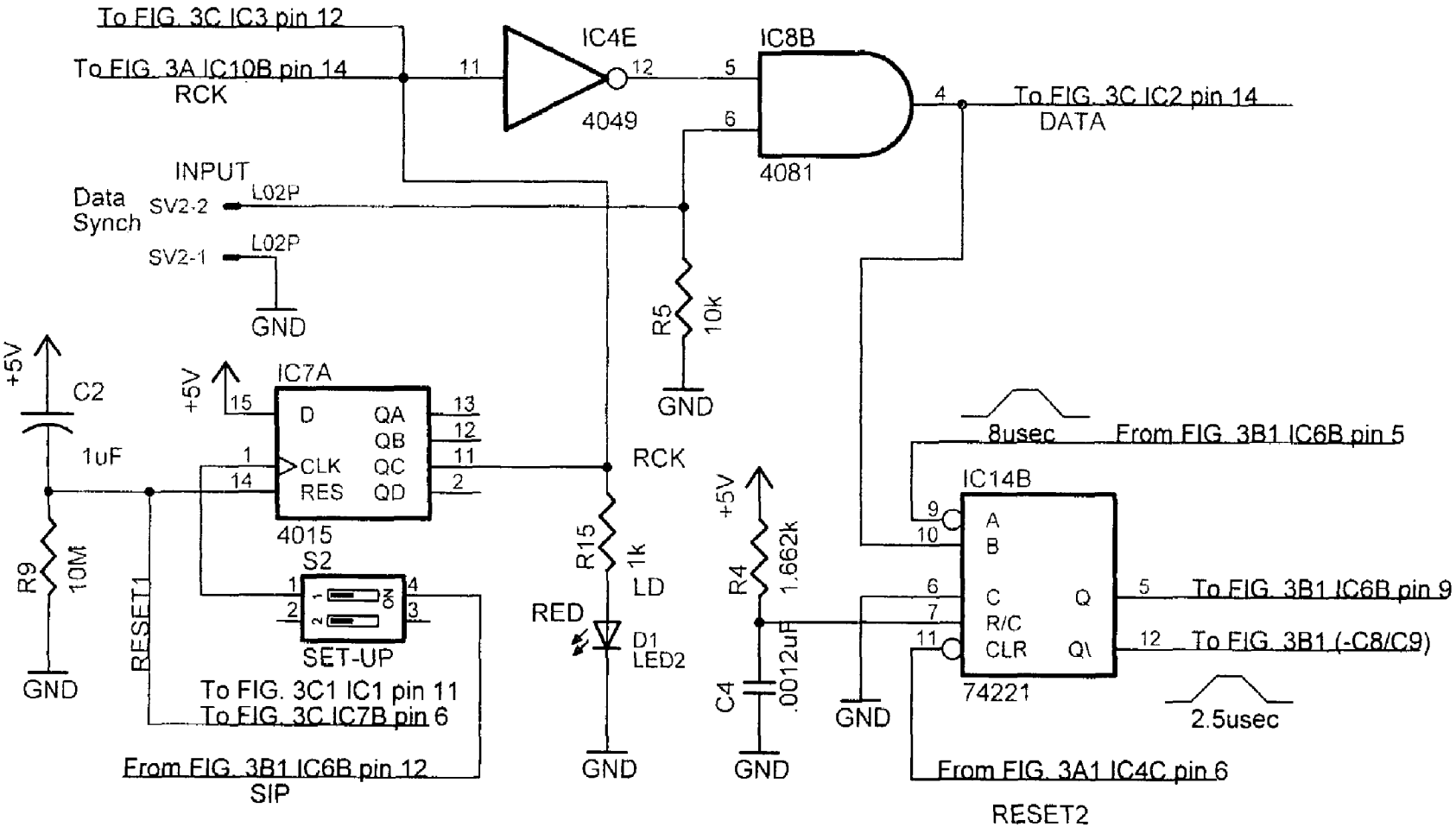
Figure 3C:
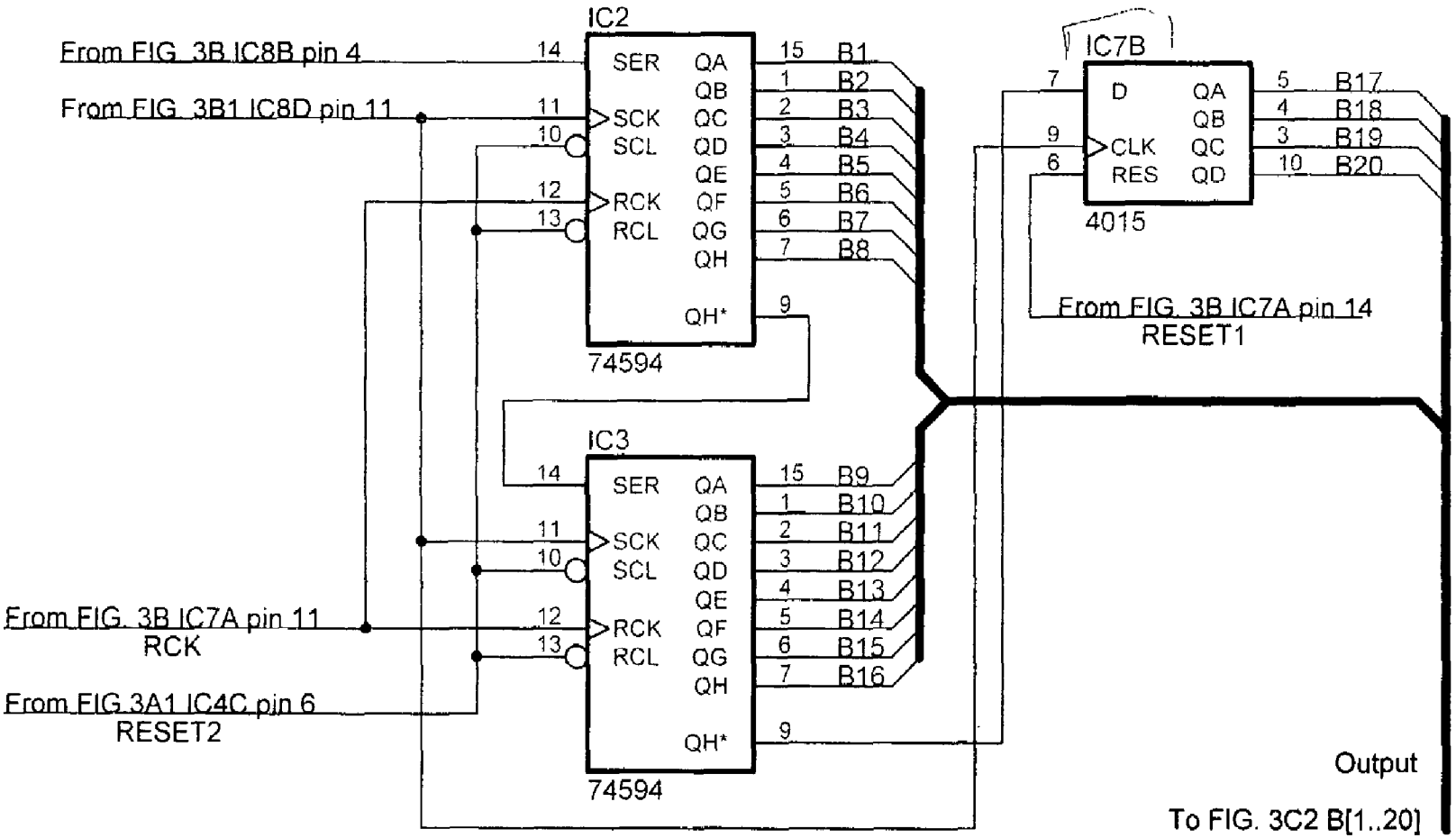
Figure 5:
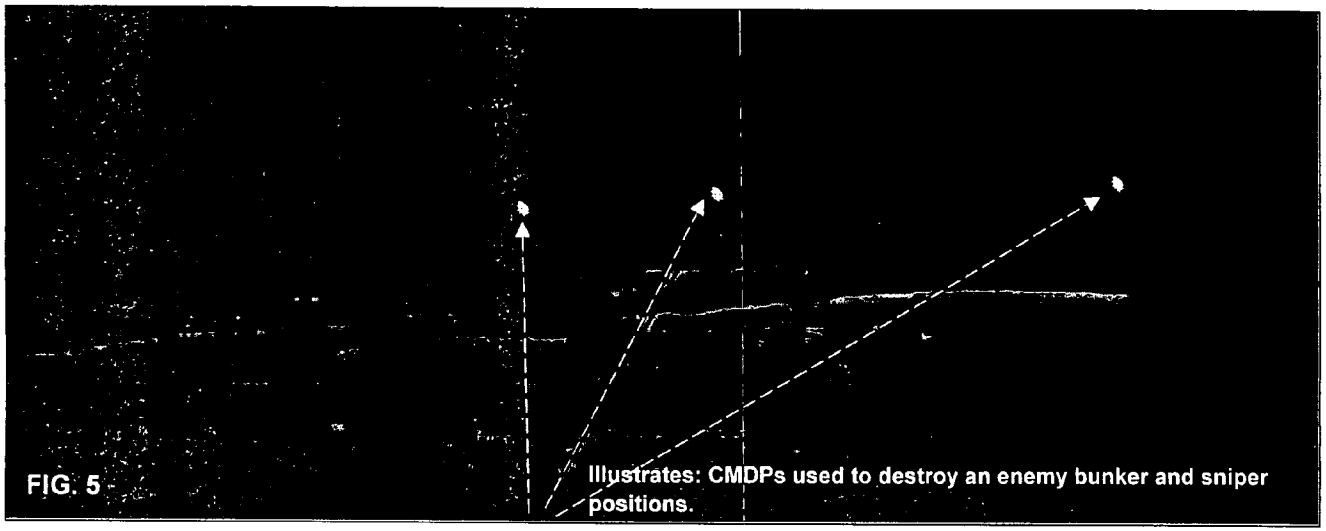
FIG. 5, is a diagram of CMDPs being fired into a reinforced bunker on a mountaintop and detonating in mid-air according to another embodiment of the preferred invention.
Figure 6:
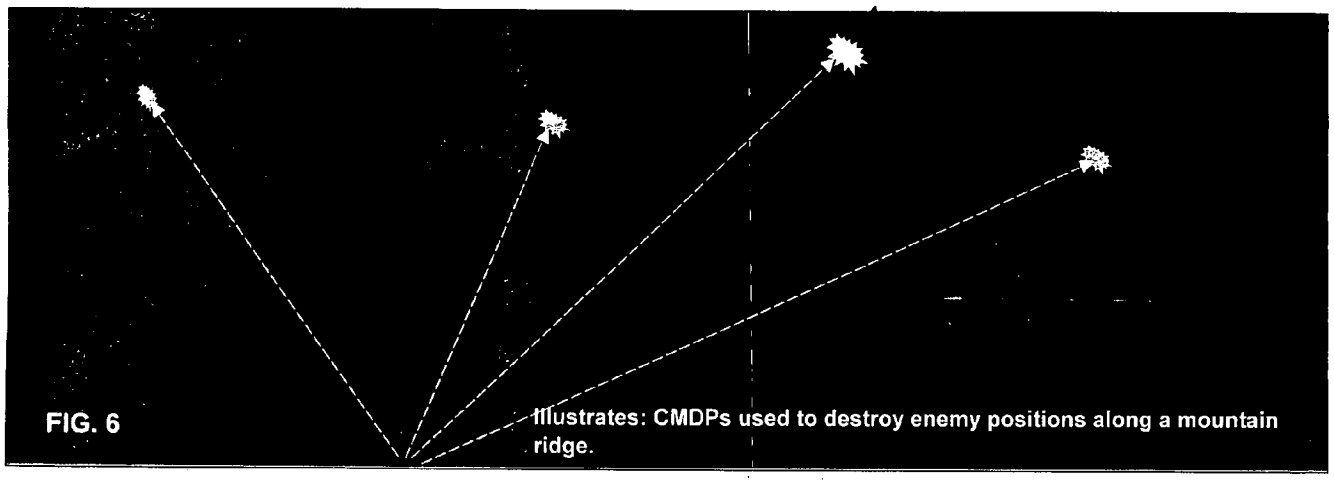
FIG. 6, is a diagram of CMDPs being fired, according to one embodiment taking out enemy positions concealed along a mountaintop ridge.
Figure 8:
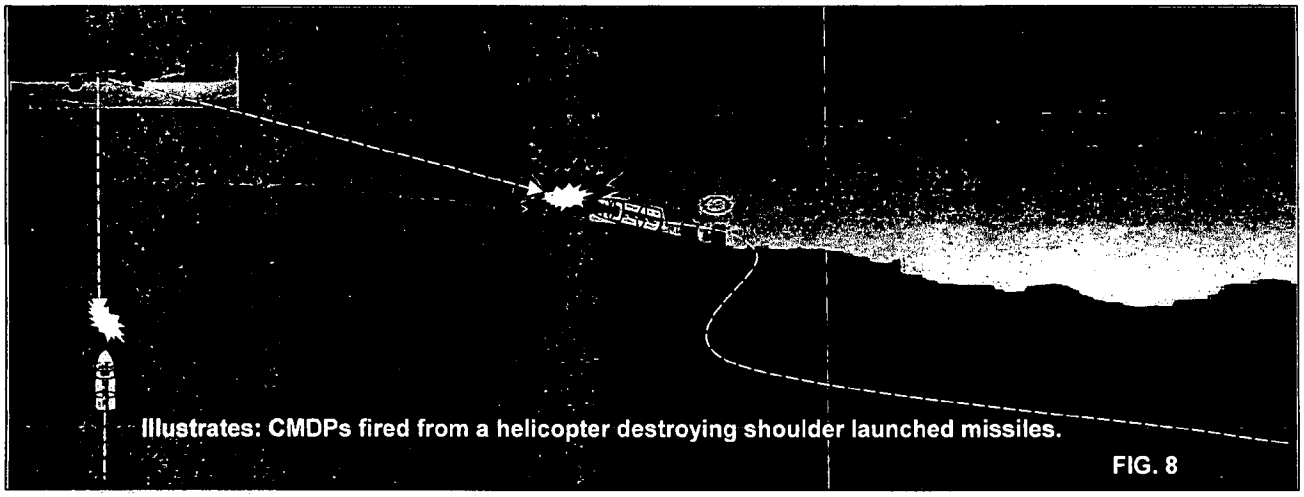
FIG. 8, is a diagram of a helicopter according to one embodiment, defending against shoulder launched missiles using CMDPs.
Figure 7:
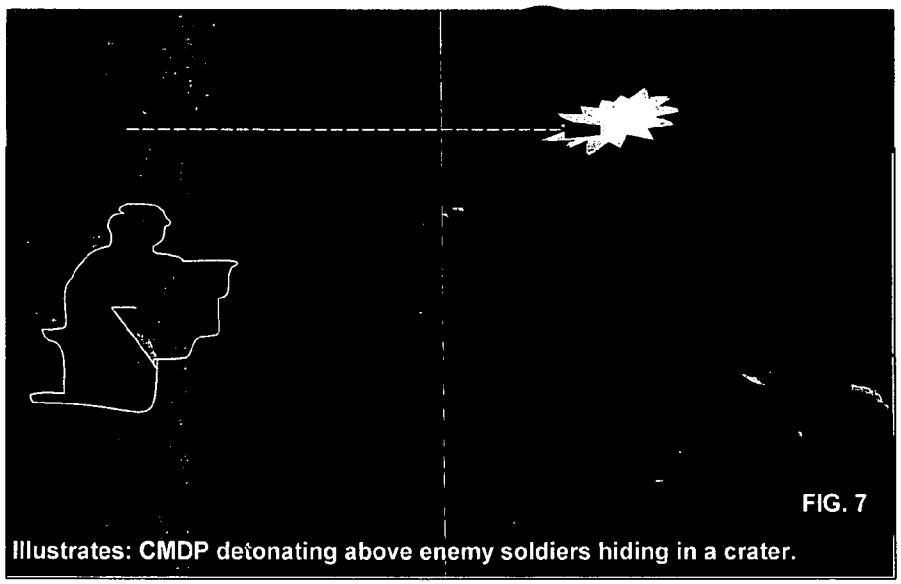
FIG. 7, is a diagram of a CMDP according to one embodiment, detonating over the enemy in a crater.

The CMD is supplied voltage via switch FIG. 3C3 S4 and the voltage regulator U2 pin 2 (+5V). All +5V and Ground symbols, respectively refer to the same connection point on FIG. 3Xn. FIG. 3C3 J1 is the battery charger input jack. Power is applied via S4 to FIG. 3B C2/R9 and FIG. 3A1 C3/R8 series circuits simultaneously resetting all FIG. 3Xn circuits via FIG. 3B C2/R9 (RESET1) and FIG. 3A1 IC4C pin 6 (RESET2). RESET1 terminates into IC7A pin 14 and FIG. 3C IC7B pin 6 while RESET2 is terminated into FIG. 3A IC13A pin 1, IC10B pin 15 and IC10A pin 1, FIG. 3B IC14B pin 11, FIG. 3B1 IC6B pin 11 and FIG. 3C IC3 pin 13 & 10 and IC2 pin 13 & 10. The CMD is now ready for data input.

The CMD is not limited to a manual power switch to turn on, reset or turn off the CMD, it can also be equipped with an automatic on/off switching circuit that will accomplish the same function using an input code or tone. A CMD on/off control has many advantages when the CMPD is used in a rapid or automatically fired mode.

Figure 10A:
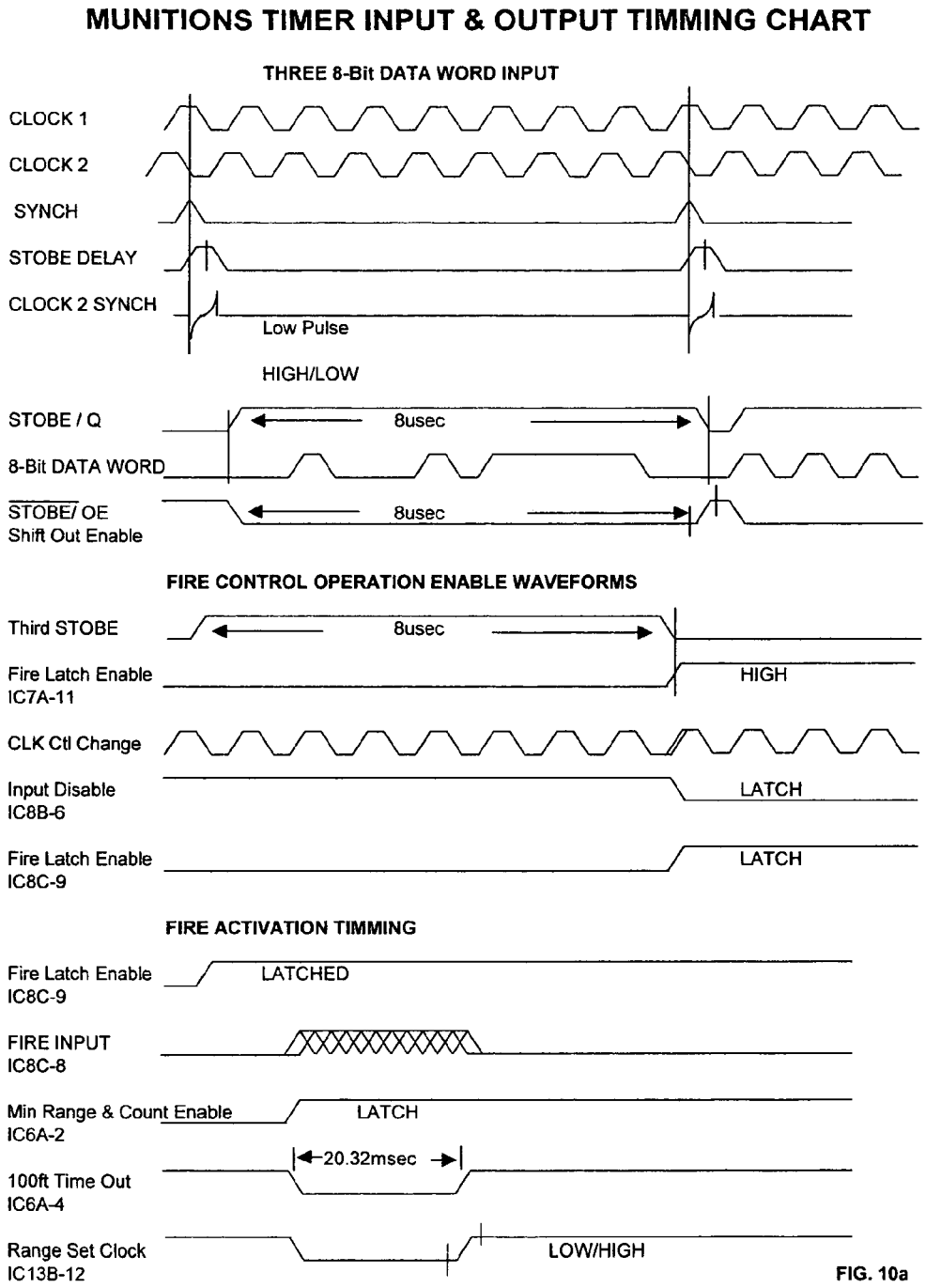
FIGS. 10*a* & 10*b*, are diagrams of the Munitions Timer Input & Output Timing Chart according to one embodiment of the preferred invention.

FIG. 3B IC8B pin 5 is initially enabled by IC4E pin 12 via a low output at IC7A pin 11. The sync pulse (SYNCH) shown on FIG. 10*a* is applied to FIG. 3B IC8B pin 6 to initiate IC 14B pin 10. Simultaneously, IC14B pins 5 and 12 outputs are activated. IC14B pin 5 is applied to FIG. 3B1 IC6B pin 9 to activate pin 5 (STROBE) and enable IC8D pin 12 and FIG. 3B IC14B pin 9. FIG. 3B IC14B pin 12 is applied to parallel capacitors FIG. 3B1 C8/C9 and R18 series circuit creating a high input state for QG1 pin 1 to synchronize QG1 pin 5 (CLOCK) with STROBE creating SCK at IC8D pin 11. SCK is the synchronized memory data input clock for FIG. 3C IC2 pin 11, IC3 pin 11 and IC7B pin 9. Three 8-bit data words immediately follow the synch pulse via FIG. 3B IC8B pin 4 into FIG. 3C IC2 pin 14. After the memory data is input, FIG. 3B1 QG1 pin 5 becomes a free running clock.

FIG. 3B1 IC6B pin 12 (SIP) is simultaneously activated at the same time as STROBE and pulse FIG. 3B IC7A pin 1 via S2 pin 1 (closed) during normal operations. When S2 is open, the CMD enters the TEST SETUP mode forcing IC4E pin 12 to remain high. A high state at IC7A pin 11 (RCK) disables IC8B pin 5 and data from IC8B pin 4. RCK (high) triggers FIG. 3C IC2 and IC3 pins 12 to transfer data to BUS B. IC7A pin 11 becomes (high) only after three 8-bit words enters into memory. After the data is input into memory, and transferred to BUSS B, the data input is disabled via FIG. 3B RCK.

FIG. 3B RCK (high) tells the CMD to disable data input, transfer memory to BUS B, and enable firing detection and BUS A comparison input. This is accomplished by disabling the safety features on FIG. 3A IC8C pin 9, IC10A pin 6, IC10B pin 10 and IC13A pin 6. Components on FIG. 3A IC10B and IC8C are safety features incorporated into the CMD to control firing detection. RCK triggers IC10B pin 14 to activate pin 10—simultaneously enabling IC8C pin 9 and FIG. 3C2 IC4D pin 9 (enabling the firing detection and BUS A input). FIG. 3A S1 is the pressure or firing switch shown on FIG. 1*e* that is activated by the combustion impact inside the shell during launch. S1 causes FIG. 3A IC17B pin 4, IC8C pin 10 and IC10A pin 6 to invert states and simultaneously enables FIG. 3A1 IC6A pin 2, IC13B pin 14 and FIG. 3A2 U1 pin 4. FIG. 3A2 U1 determines the count pulse width, FIG. 3A1 IC6A pin 4 controls the distance required for the projectile to travel before arming IC13B pin 12 which activates pin 10 and simultaneously enables one of the two safety states for FIG. 3A2 IC16 pin 1, and IC8A pin 1. FIG. 3A2 IC8A pin 3 normally (low) forces FIG. IC15A pin 2 (high) and enable IC15A pin 3 to output the count. When IC8A pin 3 is high, D4 (RED LED) illuminates to indicate that BUS B and A matched. IC15A pin 3 is connected to FIG. 3C1 IC1 pin 10 (counter input). IC1 and IC9 combine to create a 20-bit counter BUS A output.

FIG. 3C2 IC12, IC11 and IC5 illustrate how BUS A and B are terminated into the comparators' inputs. As the circuit computes the distance, the CMDP travels to the target area. When BUS A matches BUS B, FIG. 3C2 IC11 pin 6 & IC16 enables FIG. 3A IC13A pin 2, to activate pin 6 (FLATCH1) to latch FIG. 3A2 IC16 pin 2 & IC8A pin 2 (disabling the count output) IC15A pin 3, illuminating D4 and arming the second safety detonation state at IC16A pin 2 and activating IC16 pin 3 which detonates the munitions.

Many safety latch states are built into the circuitry to prevent faulty detonation. All aspects of the CMD circuitry activates only if pre-conditions are met.

Munitions Timer Input & Output Timing Chart

Figure 10B:
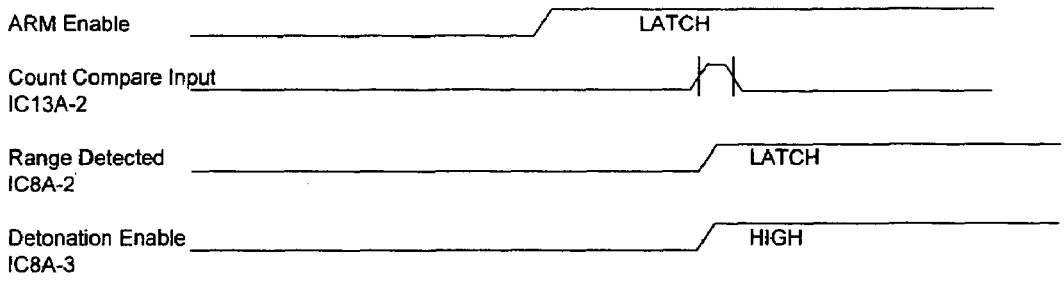

FIGS. 10*a* & 10*b* refers to the waveforms for the input clock and CMD timing and state changes at: IC7A-11 & IC8B-6, IC8C-9 & IC8C-8, IC6A-2 & IC6A-4, IC13B-12, IC13A-2, IC8A-2 and IC8A-3.

Clock1, refers to the input clock frequency of the input device, and Clock2, refers to the clock frequency of the CMD. The input data frequency and onboard frequency are the same and use SYNCH to synchronized them for data input transfer. Also, all timing signals depend on the clock operating frequency for operation.

CMDP Operation, Functionality and Purpose

For the purpose of the present description and appended claims, by way of operation, functionality and purpose; a CMDP fired from a gun will travel a predetermined distance and upon arriving at the designated distance will detonate. The present invention relates to the firing of a shell (projectile), from a gun, gun of a tank or modified grenade launcher, which detonates accurately along a fight path at, above or beside a target from a predetermined distance. A gun equipped with a laser range finder acquires the distance to the target and downloads the data into the projectile's electronic memory with only a touch of a button while the (projectile) shell is still inside the gun. Alternately, a gun equipped with a range dialer selects a distance to a target area and downloads the data into the projectile's electronic memory with a touch of the trigger while the projectile/shell is still inside the gun. Instantaneously, as the propellant inside the shell ignites and burns; it launches the projectile. The combustible force inside the shell impacts the pressure switch FIG. 1*e*, activating and initiating the counter circuitry onboard the CMDP. As the projectile exits the gun and travels downrange towards the target, it clears a predetermined safe distance before enabling one of two munitions detonation safety states. This feature assures friendly forces are well outside the impact zone before target detonation. Also, simultaneously to the projectile's launch, the counter circuit initiates counting while still inside the gun and continues counting and comparing memory data until it reaches the target and detonates. After the memory and counter data compares and matches; a second safety detonator state enables and detonates the munitions.

The projectile's flight is totally dependant on direction and height, initial velocity and the aiming mechanism of the gun. The CMDP used in a modified grenade launcher can simultaneously download data into memory and trigger the gun. Although the laser range finder may be the optimum choice to select a distant target, a range dial selection mode can be used in conjunction to rapidly engage the same distant target or newly acquired distant targets. Additional range can be added or subtracted from the range finder data to assure exact target detonation anywhere along the CMDP's flight path. The CMDP is a fire and forget device; is not dependant on target impact and will detonate upon reaching its predetermined range. After the first projectile is fired, the user can engage another target using the same range data or newly acquired data. The CMDP is self-contained and requires no additional signaling source after launching to acquire the target. The CMDP can be fitted with many types of munitions; white phosphorus, illumination, high explosive, smoke, fragmentation and cluster munitions or any number of munitions in the military's inventory. This new technology will dominate battles, minimize friendly causalities and reduce the duration of wars.

Although the invention has been shown and described with respect to a certain preferred embodiment, it is obvious that equivalent alterations and modifications will occur to others skilled in the art upon reading and understanding of this specification. The present invention includes all such equivalent alterations and modifications and is limited only by the scope of the claims above.

What is claimed is:

1. A projectile device for detonating Munition in flight along a trajectory path after being fired from a gun, the projectile device comprising:

(a) a modified shell; and (b) a cartridge associated with said shell prior to firing, containing a launch propellant for accelerating said projectile along the barrel of the gun to a muzzle velocity; and wherein said modified shell includes:

c) the projectile device associated with said shell prior to launching, containing Munitions; and d) the projectile device associated with said shell prior to firing, containing an electronic system; and e) the electronic system associated with said shell prior to firing, containing electronic range measuring circuitry; and f) the electronic system associated with said shell prior to firing, containing the electronic detonator circuit;

wherein said modified shell includes:

(i) a symmetrical groove cut into the shell's metal base plate, around the perimeter of the primer, and (ii) a hole, penetrating the shell's outer and inner surfaces located symmetrically inside the grooves; and (iii) an electrical insulating material overlaying the symmetrical groove and hole; and (iv) a thin, symmetrical, electrical, metallic ring with stem and attached wire penetrating the insulated hole, while overlaying the symmetric insulated ring; and (v) the insulated wire attached to the metallic ring runs inside the length of the shell terminating into an input connector; and (vi) a ground wire attached and insulated goes into the shell's inner wall and terminates into the same input connector; and (vii) the insulated input connector is attached to the cruise munitions detonator circuitry inside the projectile.

2. The projectile device of claim 1, further comprising the electronic system associated with said shell for monitoring during flight and detonation of said shell.

3. The projectile device of claim 2, wherein said electronic system further comprises:

a) a power switch, for resetting the electronic system; and b) a digital data link, for data input; and c) a digital memory, for storing data; and d) a data input disable state, for data lockout; and e) a pressure switch, for enabling the counter/comparator circuitry; and f) a safety range detector, for assuring target detonation is outside the safety zone; and g) a electronic detonator, for detonating the munitions; and h) a battery charging circuit, for charging batteries.

4. The projectile device of claim 3, wherein said electronic system is a cruise munitions detonator projectile or CMDP.

5. The projectile device of claim 4, further comprising a cruise munitions detonator projectile inside said shell for detonating, over or in front of; at the rear of, or inside a target area with pinpoint accuracy.

6. The projectile device of claim 3, wherein said cruise munitions detonator projectile is a range measuring device.

7. The projectile device of claim 4, further comprising an electronic system associated with said shell for munitions detonation.

8. The projectile device of claim 1, wherein said shell is a munition.

* * * * *